US005174556A

United States Patent [19]

Taylor et al.

[11] Patent Number: 5,174,556

[45] Date of Patent: Dec. 29, 1992

[54] FINISHER WITH BINDER PRINTING

[75] Inventors: Thomas N. Taylor, Rochester; Geoffrey C. Williams, Penfield; David P. Van Bortel, Fairport; Robert A. Panos, Penfield, all of N.Y.; Dennis A. Caggiano, Aurora, Colo.

[73] Assignee: Xerox Corporation, Stamford, Conn.

[21] Appl. No.: 795,214

[22] Filed: Nov. 20, 1991

[51] Int. Cl.[5] ..... B41F 13/54; B42B 2/00

[52] U.S. Cl. ..... 270/1.1; 270/53; 270/58; 412/33

[58] Field of Search ..... 270/1.1, 53, 58; 412/6, 412/8, 18, 33, 34, 36

[56] References Cited

U.S. PATENT DOCUMENTS

| | | | |
|---|---|---|---|
| 4,552,497 | 11/1985 | Kockler | 270/53 |
| 4,582,421 | 4/1986 | Hamlin et al. . | |
| 4,586,640 | 5/1986 | Smith . | |
| 4,603,971 | 8/1986 | Kukucka et al. . | |
| 4,768,056 | 8/1988 | Tomoyori et al. . | |
| 4,797,048 | 1/1989 | Doery . | |
| 4,985,729 | 1/1991 | Sampath et al. . | |
| 4,986,713 | 1/1991 | Zoltner et al. . | |
| 5,005,815 | 4/1991 | Auksi | 270/1.1 |
| 5,085,417 | 2/1992 | Copham | 270/1.1 |
| 5,143,362 | 9/1992 | Doanne et al. | 270/58 X |

FOREIGN PATENT DOCUMENTS

| | | | |
|---|---|---|---|
| 98562 | 4/1989 | Japan | 270/1.1 |
| 255457 | 10/1990 | Japan | 270/95 |

*Primary Examiner*—Edward K. Look
*Assistant Examiner*—John Ryznic
*Attorney, Agent, or Firm*—Oliff & Berridge

[57] ABSTRACT

A document finisher includes a printing station for printing on the binding of a book. The printing station in one embodiment prints on the binder tape before the book is bound. In a second embodiment, the printer prints on the binding after the book is bound. The printing stations are space efficient and designed to be easily incorporated with preexisting stations in document finishers. Ink jet printers and impact-type printer may be utilized.

14 Claims, 6 Drawing Sheets

FIG. 1
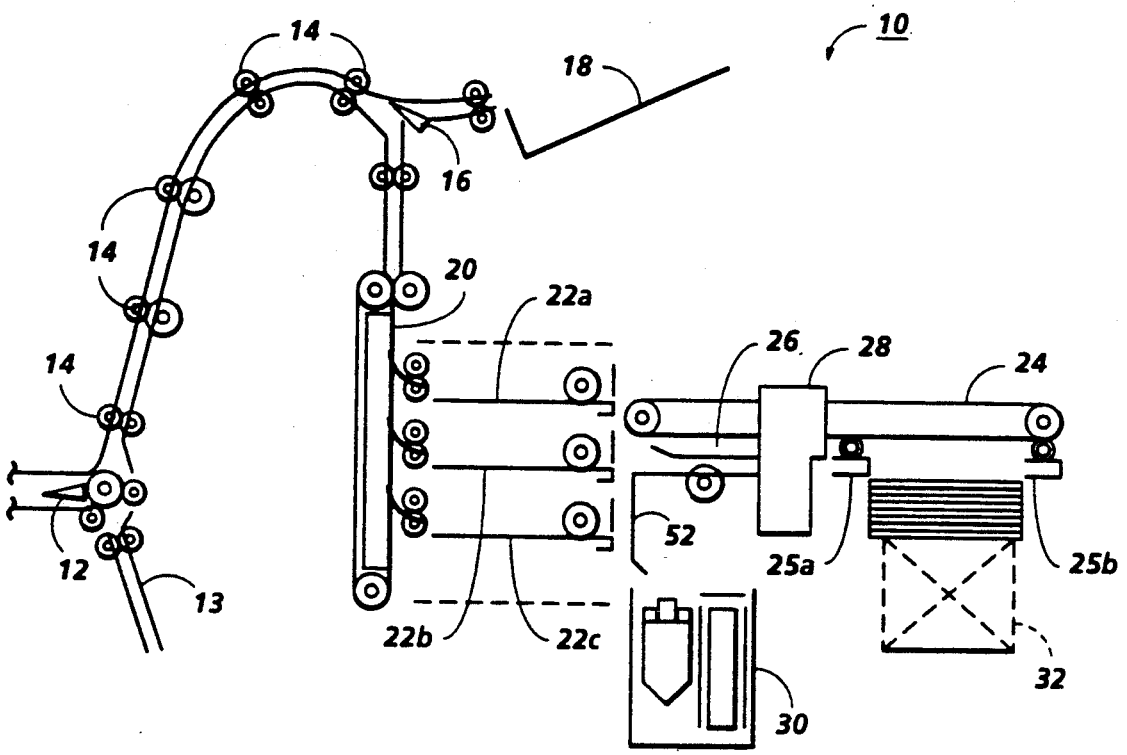
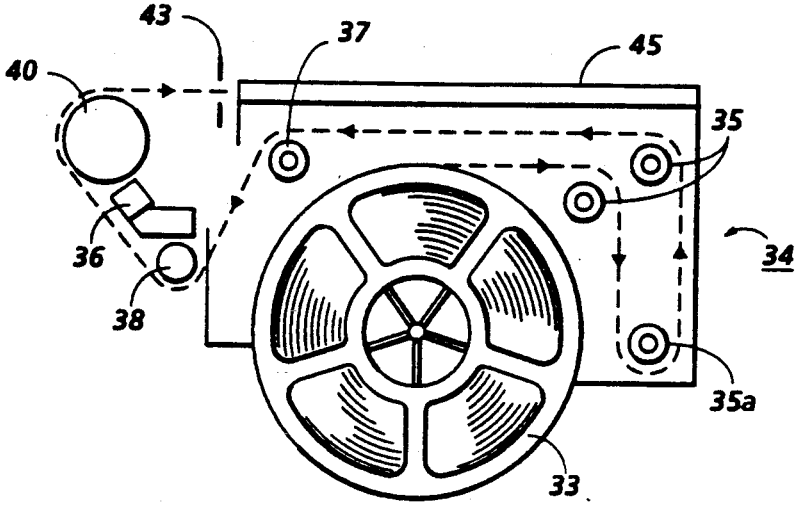
FIG. 2

FIG. 3
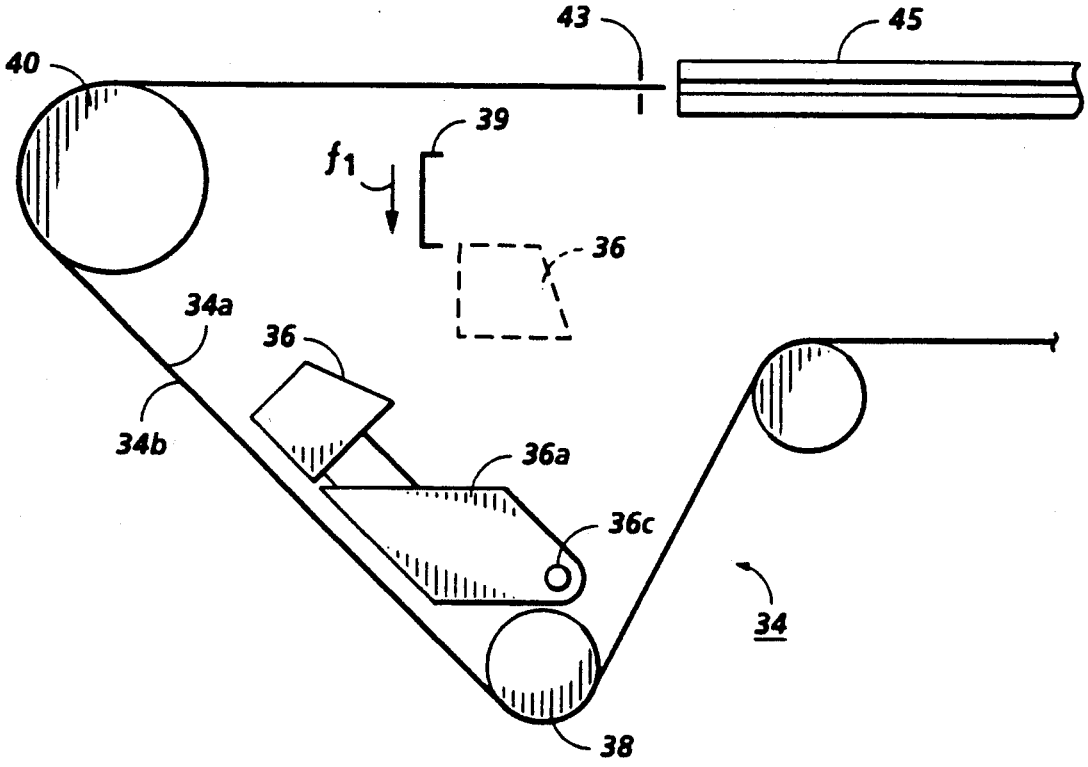
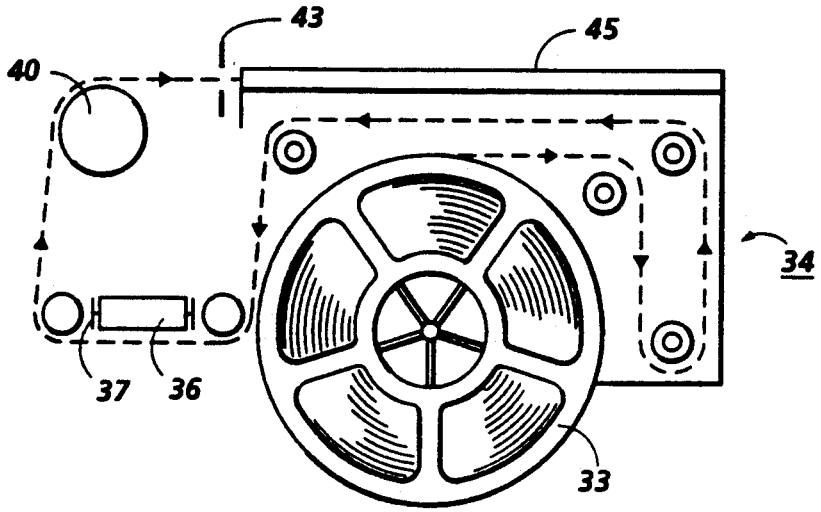
FIG. 4

FIG. 5A
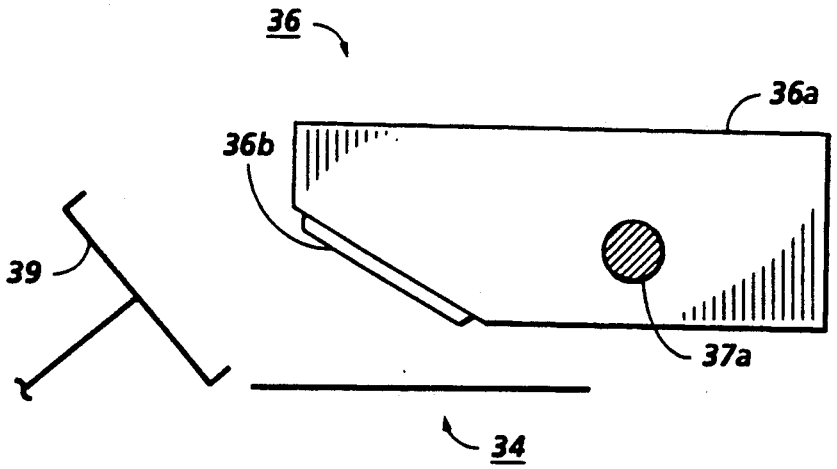
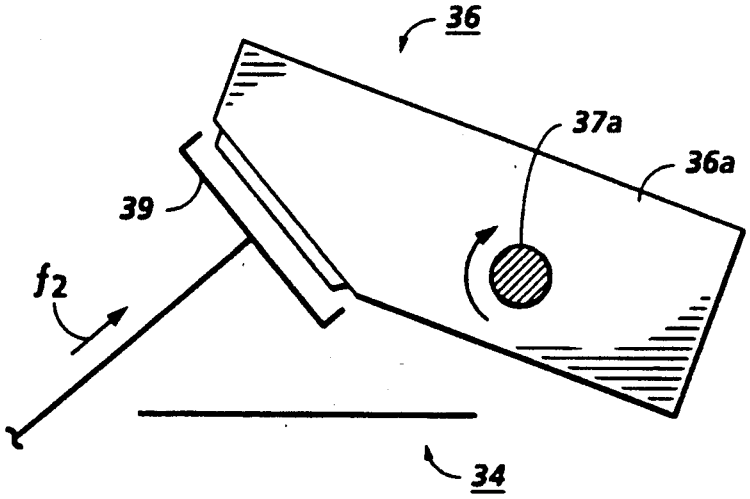
FIG. 5B

FINISHER WITH BINDER PRINTING

BACKGROUND OF THE INVENTION

1. Field of the Invention

This invention relates to a finisher in a reproduction machine and in particular, to a finisher for providing books or booklets with printed bindings.

2. Description of Related Developments

It is known in the art to provide finishers for reproduction machines which can provide finished documents in several modes, such as unstapled sets of documents, stapled sets of documents, or bound books or booklets. Such finishers in combination with reproduction machines are shown for example in U.S. Pat. Nos. 4,586,680 and 4,985,729. Although this equipment provides bound books, the bindings of such books are blank and, if labeling is desired, it must be applied in a separate step.

However, it has become increasingly important to produce completely labeled book as a part of the finishing operation. This enhances the usefulness of the booklet to the end user, aids in identifying reproduction job lots and decreases the overall production cost of the book.

An important design constraint for reproduction equipment is that the required floor space is minimized. Therefore, it is desirable to include the printing function in a document finisher without an appreciable increase in space requirements. Further, in order to limit development costs, it is useful to incorporate the printing function with minimal redesign of existing binding stations. Thus, the station must be compact and capable of being easily integrated into existing finishing equipment.

SUMMARY OF THE INVENTION

It is an object of the invention to enhance the finish state of book formed in a document finisher.

It is a further object of the invention to provide, as a part of a reproduction system, a finisher which applies a binding to form a book and prints information on the binding.

It is a further object of the invention to provide printing arrangements that are compact and easily integrated with existing finishing station designs.

These and other objects of the invention are achieved by incorporating a printing system into a document finisher. In one embodiment, the binder tape is printed and applied to an assembled stack of sheets to form a book. The printing station is integrated with the binding station to minimize space requirements. In another embodiment, a printing station is arranged to print on the binding of a bound book.

BRIEF DESCRIPTION OF THE DRAWINGS

FIG. 1 is a schematic view of a document finisher that accepts sheets from a reproduction machine;

FIG. 2 schematically illustrates a side view of a binding station having a thermal ink jet printer for printing on a book binding tape;

FIG. 3 is an enlarged view of the printing station shown in FIG. 2;

FIG. 4 schematically illustrates a side view of a second embodiment of a binding station having a thermal ink jet printer;

FIG. 5A and 5B are enlarged schematic illustrations of the printing station shown in FIG. 4;

DESCRIPTION OF THE PREFERRED EMBODIMENTS

Figure 6:
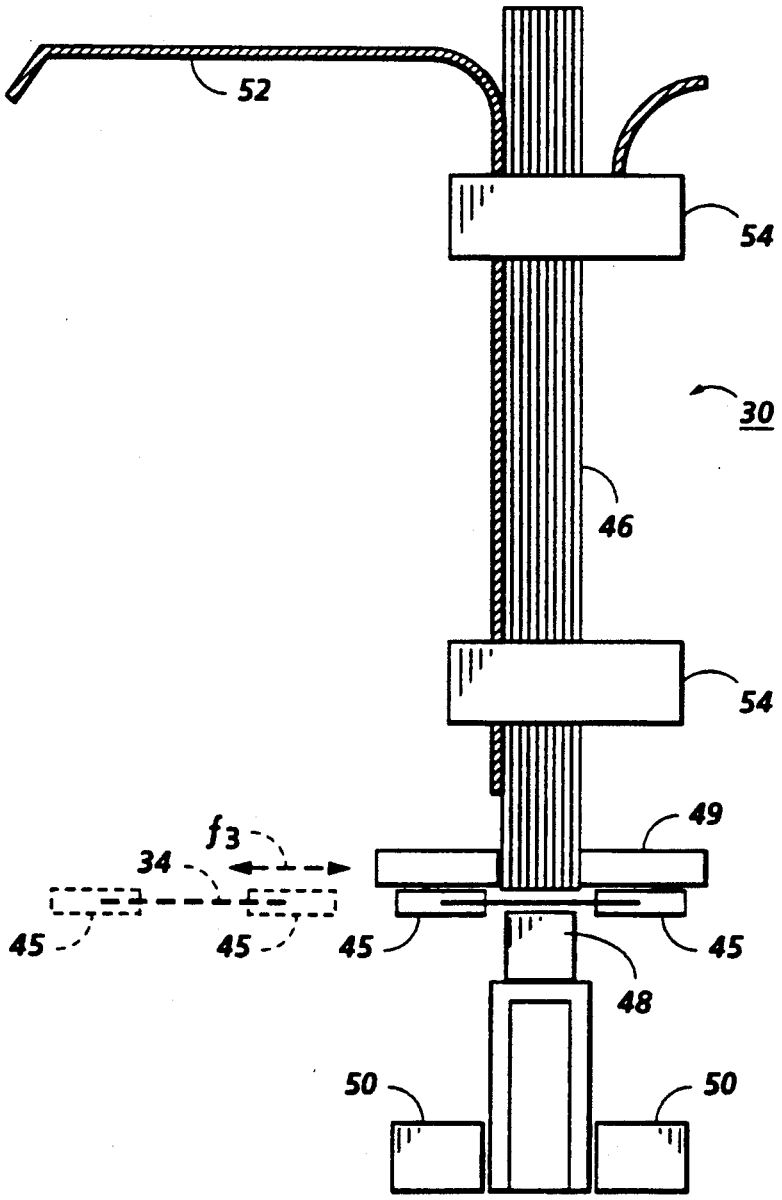
FIG. 6 is a schematic illustration of an end view of a book binding station.

The disclosed finishing system is primarily for use with reproduction or printing equipment, particularly electrophotographic copiers. Referring to FIG. 1, a typical document finisher 10 includes a system for accepting printing sheets and applying several different modes of finishing. In the arrangement shown, the sheet input includes a gate 12 that is placeable in a position to feed individual sheets back into the reproduction equipment, for example for duplex processing, by a sheet feed 13. In the alternative position, the gate 12 directs the sheets into a conveying system comprising a plurality of rollers 14 forming a sheet feed path to a gate 16. If the machine control is set for no finishing, the gate 16 directs the sheets into a receiving tray 18.

If collation and further finishing is desired, the gate 16 directs the sheets into a vertical collator 20 that feeds the sheets into a plurality of stacking bins 22*a*, 22*b* and 22*c*. The bins 22 are preferably vertically movable so that finished stacks of sheets can be removed from the bins by the stack transfer belt 24 or other known transfer systems, such as those using pneumatically driven transfer members, that are driven back and forth to place the set clamps 25*a* and 25*b* in appropriate positions for moving stacks or finished books. In the arrangement shown, the set clamp 25*a* is movable toward the bins 22*a,b,c* and draws stacks therefrom to a pivoted stack receiver 26 which can present a stack to a stapling station 28 or to a binding station 30. Unbound but collated stacks or stapled or bound stacks are positioned at a stacker station 32 by the second set clamp 25*b*. Alternatively, the stacker station 32 can include a binder printing station, as will be described.

As previously mentioned, a book with a printed binder can be made by preprinting on a binder tape that is applied to an edge of a stack of sheets or printing on the spine of a book after the binder has been applied to the stack to form a book. The arrangement shown in FIG. 2 is a system in which the binder tape is preprinted before application to an assembled stack of sheets. The printing system may be configured, by appropriate controls, to print characters vertically or horizontally on the tape 34. Typically, binder tape supply reel 33 carries the supply of binder tape 34. The binder tape 34 carries a heat activatable adhesive on one surface 34*b* (FIG. 3). In the arrangement shown in FIGS. 2 and 3, the binder tape 34 travels from supply reel 33 to a series of rollers 35, including a tension roller 35*a*. The binder tape feeds over guide roller 37 to a roller 38, that can be utilized as an encoder roller for providing control signals for a printer, such as thermal ink jet printer 36. The non-adhesive bearing surface 34*a* is disposed to receive ink deposited by the thermal ink jet printer 36 as the tape moves. The printer 36 includes a cartridge 36*a* which is mounted to move transversely to allow the printer head to shift so that characters can be printed on the spine portion of the tape, the front or back flaps of the tape or a combination of these locations. An ink supply is incorporated in cartridge 36*a*. As is conventional with thermal ink jet printers, a maintenance station is associated with the printer 36 for maintaining the printer in ready-to-use condition when no printing is taking place. The cartridge is pivotally mounted about the axis of shaft 36*c* to allow the printer 36 to be positioned in the phantom line position shown in FIG. 3. In this position, a maintenance station 39, which provides for cleaning the face of the printer and vacuum priming the printer, can be brought into position by movement in the direction of arrow $f_1$ by suitable transfer structure (not shown). The printer 36 may also be capable of being moved transversely, in a direction perpendicular to the plane of FIG. 3, in order to remove the printer from the binder tape path when no printing is to take place.

If the printer is an impact printer, such as a dot matrix or daisy wheel printer, a suitable platen surface (not shown) is provided to support the tape 34 as the printing takes place.

The binder tape 34 is then turned over on feed roller 40 to present the adhesive bearing side 34*b* upwardly. Ideally, roller 40 engages the printed surface of the tape only at the outside edges, where substantially no printing has taken place. For example, the roller 40 may have a central circumferential depression (not shown) for providing relief to the printed surface 34*a* of tape 34. This lessens the likelihood of smearing the ink which has just been deposited on the tape.

The tape printing operation takes place at high speed and is desirable to utilize a relatively fast drying ink so that subsequent handling of the tape does not deface the printing applied to the tape as, the ink must be heat stable so that it can withstand the binding operation.

FIG. 4, 5A and 5B show a second embodiment of a binder/printing system having basically the same elements as shown in FIG. 2, which are like numbered. In the FIG. 4 design, the printer 36 is arranged differently than as shown in FIG. 2. In this embodiment, the thermal ink jet printer 36 and its associated cartridge are mounted in a mount 37 to pivot about an axis defined by shaft 37*a*. The axis of shaft 37*a* is substantially parallel to the direction of movement of the section of binder tape 34 adjacent to the printer, which is about to receive printing. In the position shown in FIG. 5A, the printer is positioned to print on the tape 34 as the tape travels by the printer. When it is necessary to place the printer in a maintenance position, the printer cartridge is pivoted about shaft 37*a* to raise the face 36*b* of the printer. In this position, a maintenance station 39 can be advanced linearly in the direction of arrow $f_2$ by a suitable member, such as an air cylinder (not shown) to be placed against the face 36*b* of printer 36 to perform the functions associated with the maintenance of thermal ink jet printers. The station 39 can be linearly retracted in the direction opposed to arrow $f_2$ to a home position disposed on at one side of the tape. This arrangement provides a space efficient, low cost printing station.

Referring to FIGS. 2, 3, 4, 5, 6 and 7 the printed binder tape is fed into a pair of opposed, grooved edge holding members 45 by the roller 40. The tape 34 is fed past a cutter 43 for cutting the binder tape 34 to match the length of an edge of a stack of sheets to be bound. After the tape is cut, a pusher (not shown) pushes the tape into the members 45 so that the tape is even with a lateral edge of the stack 46. The edge holding members 45 are initially positioned in alignment to receive the tape 34 fed by roll 40, as shown in FIGS. 2 and 3. The members 45 are then shifted laterally from the position shown in FIG. 3, corresponding to the phantom positions shown in FIG. 6, in the direction of arrow $f_3$. This places the binder tape 34 to be applied to an edge of the stack 46 between the stack 46 and a heated binding head 48. The tape edge holding members 45 are pivotably mounted adjacent the binder plate 48.

The binder tape feeding arrangements shown in FIGS. 2 and 4 are mounted on a substructure (not shown) that also includes the binder plate 48 and associated elements, such as calipers 49 and heated flappers 50.

FIG. 6 shows the condition of the binder station just as the binder tape is about to be applied to the stack 46. In this arrangement, the stack 46 is held on a pivoted tilt bed 52 by a pair of pneumatic clamps 54 to dispose the edge of the stack to be bound in facing relationship to the heated binding head 48. A pair of pneumatic calipers 49 hold the sheets of the stack 46 in compressed condition as the binder tape 34 is applied by the binding head against the edge of the stack to form the spine 51 (FIG. 7) of the book.

Figure 7:
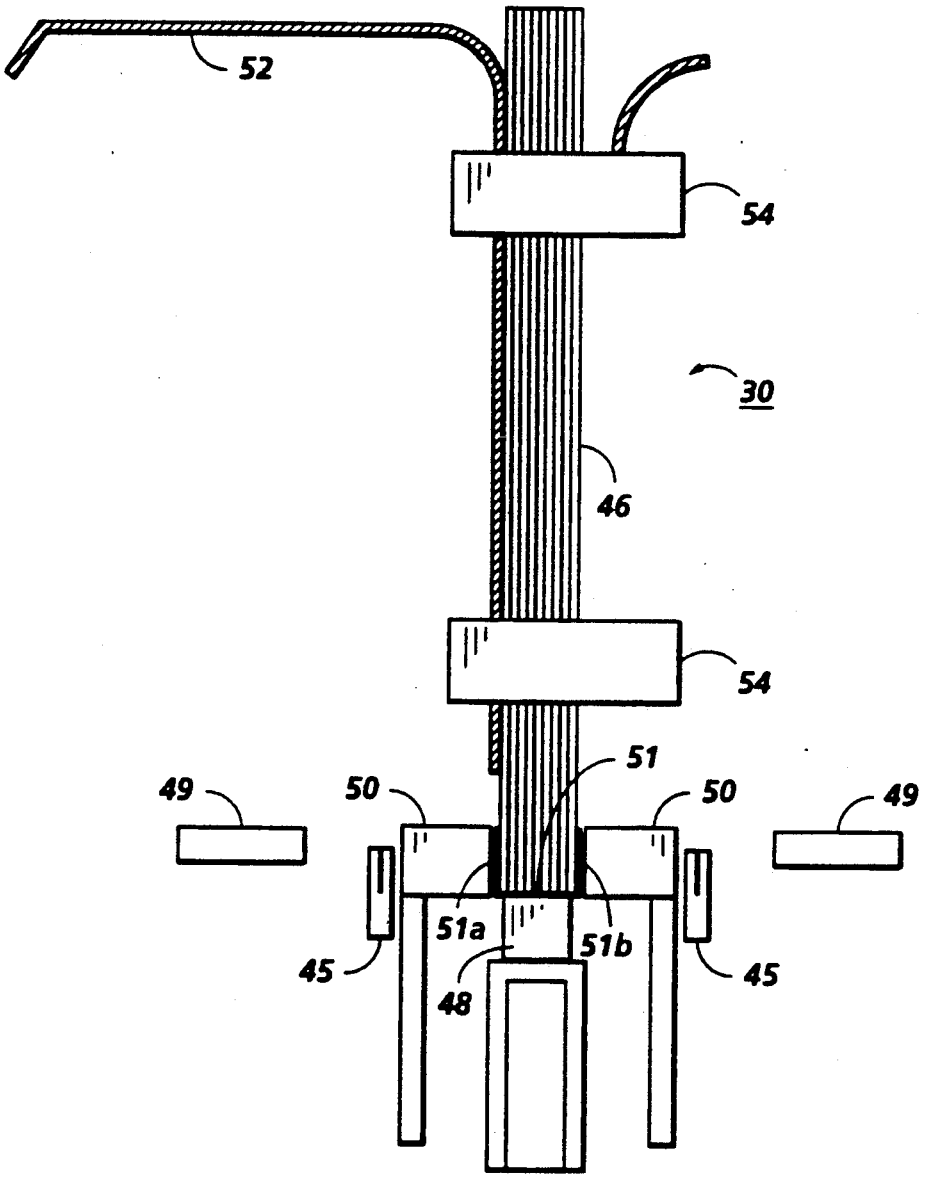
FIG. 7 is a sequential illustration of the book binding station of FIG. 6 showing application of the binder tape to the book.
Figure 8:
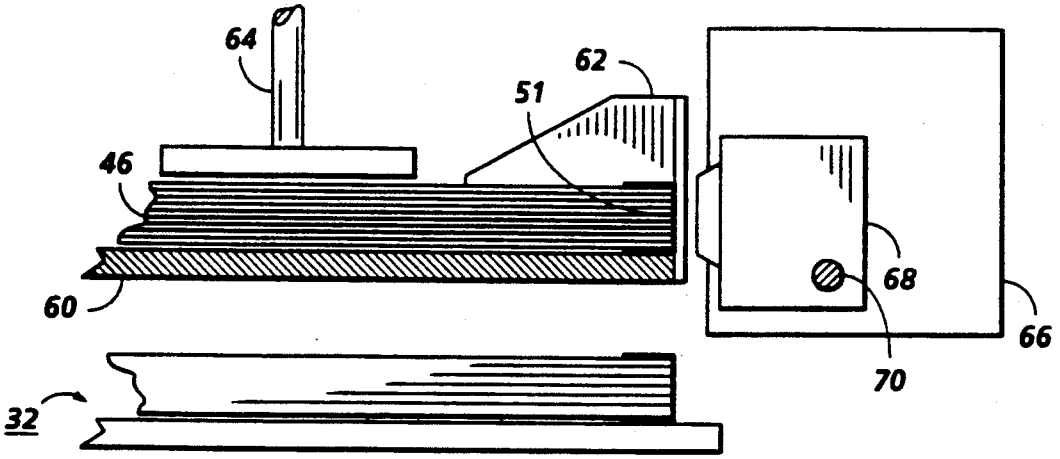
FIG. 8 is a partial sectional view showing a printing station for printing on the binder of a book.
Figure 9:
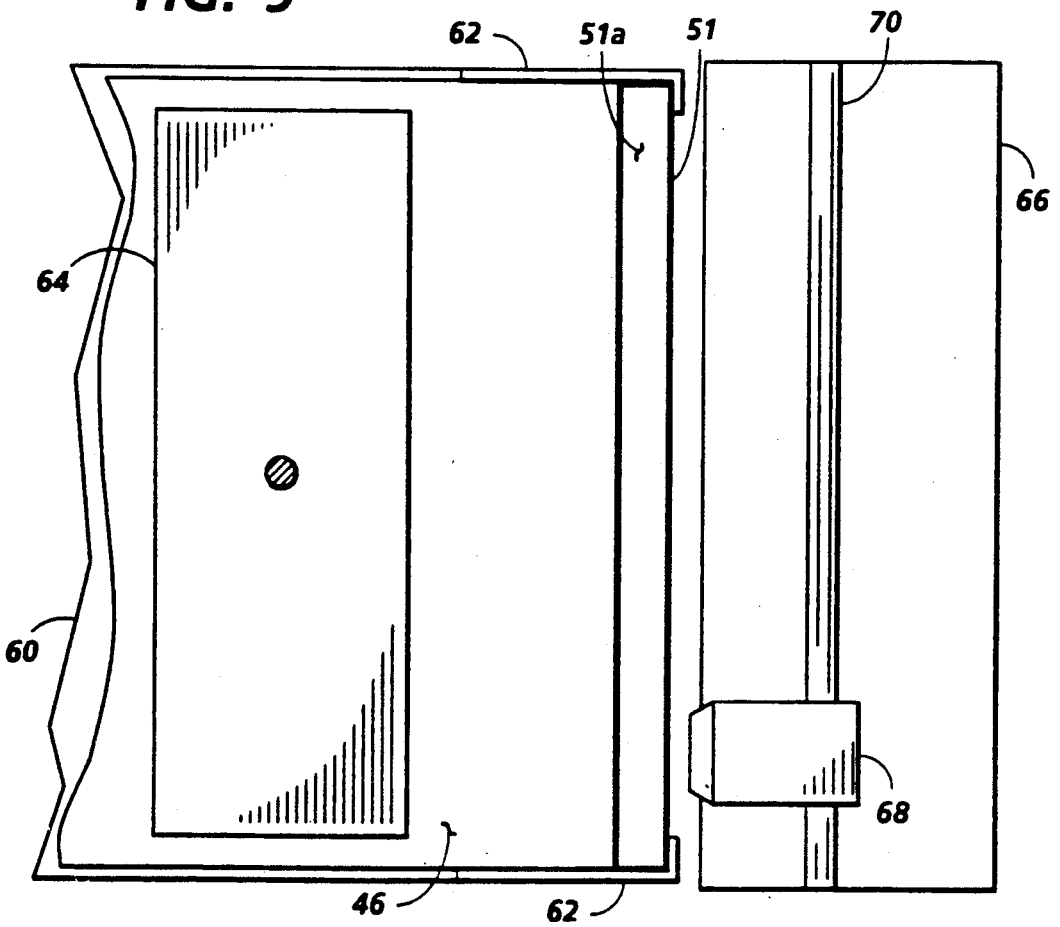
FIG. 9 is a top view of the printing station shown in FIG. 8.

FIG. 7 shows the completion of the binding operation in which the binder tape edges 51*a* and 51*b* are wrapped onto the front and rear surfaces of the stack 46. In this operation, the calipers are moved away from stack 46 as the binder flappers 50 engage the edges 51*a* and 51*b* of the tape, bend the tape edges upwardly against the side surfaces of the stack 46 and simultaneously heat the tape to activate the adhesive material.

As the binder flappers 50 are raised, they engage the edge holding members 45, pivoting the members 45 upwardly. This results in the release of the edges of the tape from the members 45. Referring to FIG. 1, after the binder tape has been applied to the stack, the tilting bed 52 is rotated upwardly and set clamp 25*b* engages the finished book and deposits it at stacker station 32.

In a third embodiment, a printing station is arranged at the location of the stacker 32 shown in FIG. 1. In this arrangement, an unprinted binder tape is applied to a stack 46 in the binder station 30. The bound book is conveyed onto a tray 60 that includes a pair of upstanding locating brackets 62 for positioning a book with the spine 51 facing outwardly. A suitable clamping member, such as a pneumatic clamp 64, engages the book and holds it in place on the tray 60.

A frame 66 is mounted for movement toward and away from the spine 51 and positions a thermal ink jet printing head 68 in a position to print on the spine. With respect to the third embodiment, a thermal ink jet printer is especially preferred, as such non-contact printing can achieve good resolution despite wrinkling or other irregularities in the spine 51 of the book. The printing head 68 is transversely movable along a rail 70 to print characters on the spine 56. Thereafter, the finished book can be placed at the stacker 32, as by tilting of tray 60 or use of a suitable transfer system (not shown).

The data printed by the printers 36 and 68 can be entered into an input device (not shown), such as a keyboard, of a microcomputer that controls operation of the printer.

The systems disclosed provide the capability to produce books with printing on the spines of the book. They are incorporated into existing equipment designs in a space efficient manner and in a manner that does not require substantial redesign of existing work stations.

What is claimed is:

1. Printing apparatus comprising:

a first printer for printing images on a plurality of sheets;

a station for assembling a plurality of said printed sheets;

a holding arrangement for holding the assembled plurality of sheets together;

a second printer;

control means for determining images to be printed by the second printer;

a printing medium for accepting images printed by the second printing means; and a station for applying said printing medium to an edge of said plurality of assembled sheets.

2. Apparatus as in claim 1, wherein the printing medium comprises a binder tape for holding the assembled sheets together.

3. Apparatus as in claim 1, wherein the first printer comprises an electrophotographic printer.

4. Apparatus as in claim 3, wherein the second printer comprises a non-impact printer.

5. Apparatus as in claim 4, wherein the second printer comprises an ink jet printer.

6. Apparatus as in claim 1, wherein the second printer comprises an impact printer.

7. Apparatus as in claim 1, wherein the second printer is located upstream of the station for applying said printing medium to the assembled sheets.

8. Apparatus as in claim 1, wherein the second printer is located downstream of the station for applying said printing medium to the assembled sheets.

9. Binding apparatus comprising:

a housing;

a receiver within the housing for receiving a plurality of sheets;

a holding arrangement within the housing for holding said plurality of sheets in aligned relationship to form a stack with an edge of said stack presented for application of a binder tape to said edge;

a binder tape supply within the housing for supplying the binder tape;

a station within the housing for applying the binder tape to the presented edge of the stack to bind the sheets together;

a printer within the housing for printing image on said binder tape; and control means for determining the images to be printed on the binder tape by the printer.

10. Apparatus as in claim 9, wherein the printer is positioned upstream of said binder tape applying means.

11. Binding apparatus comprising:

a housing;

a receiver within the housing for receiving a plurality of sheets;

a holding arrangement within the housing for holding said plurality of sheets in aligned relationship to form a stack with an edge of said stack presented for application of a binder tape to said edge;

a binder tape supply within the housing for supplying the binder tape;

a station within the housing for applying the binder tape to the presented edge of the stack to bind the sheets together; and a printer within the housing for printing on said binder tape, wherein the printer is positioned upstream of said binder tape applying means;

wherein the printer pivots about an axis parallel to the direction of movement of the tape adjacent the printer, toward and away from the tape.

12. Apparatus as in claim 11, further comprising a maintenance head for maintaining the printer, the maintenance head being movable to the printer when the printer is pivoted away from the tape.

13. Apparatus as in claim 11, wherein the printer is an ink jet printer.

14. Binding apparatus comprising:

a housing;

a receiver within the housing for receiving a plurality of sheets;

a holding arrangement within the housing for holding said plurality of sheets in aligned relationship to form a stack with an edge of said stack presented for application of a binder tape to said edge;

a binder tape supply within the housing for supplying the binder tape;

a station within the housing for applying the binder tape to the presented edge of the stack to bind the sheets together; and a printer within the housing for printing images on said binder tape; and wherein the printer is located downstream of the binder tape applying station.

* * * * *